US006253589B1

(12) United States Patent
Putz et al.

(10) Patent No.: US 6,253,589 B1
(45) Date of Patent: Jul. 3, 2001

(54) FLOW-TURNING DEVICE AND METHOD FOR PRODUCING INTERNALLY GEARED WHEELS USING TWO SETS OF INTERNAL TOOTHING

(75) Inventors: Karl Heinz Putz, Cologne; Bernd Stein, Bonn; Heinz Steinhauer, Troisdorf; Wilhelm Zimmermann, St. Augustin, all of (DE)

(73) Assignee: Dynamit Nobel GmbH Explosivstoff- und Systemtechnik, Troisdorf (DE)

( * ) Notice: Subject to any disclaimer, the term of this patent is extended or adjusted under 35 U.S.C. 154(b) by 0 days.

(21) Appl. No.: 09/424,744

(22) PCT Filed: May 28, 1998

(86) PCT No.: PCT/EP98/02922

§ 371 Date: Mar. 31, 2000

§ 102(e) Date: Mar. 31, 2000

(87) PCT Pub. No.: WO98/53934

PCT Pub. Date: Dec. 3, 1998

(30) Foreign Application Priority Data

May 28, 1997 (DE) ..... 197 22 359

(51) Int. Cl.[7] ..... B21D 22/16

(52) U.S. Cl. ..... 72/85; 29/893.32

(58) Field of Search ..... 72/82, 83, 85, 72/110; 29/893.32

(56) References Cited

U.S. PATENT DOCUMENTS 4,884,427 * 12/1989 Sawahata et al. ..... 72/82

FOREIGN PATENT DOCUMENTS

296118 * 1/1972 (AT) .
4446919 * 7/1996 (DE) .

* cited by examiner

*Primary Examiner*—Lowell A. Larson
(74) *Attorney, Agent, or Firm*—Antonelli, Terry, Stout & Kraus, LLP

(57) ABSTRACT

The invention relates to a flowturning device (1; 101) for producing an internal geared wheel (17) with inner toothing, one set of which is slanted. The workpiece (9) is held by a retaining member (16; 116) during shaping of the first inner toothing. The workpiece (9) is held by the first toothing on the first shaping toot (2; 102) during shaping of the second inner toothing. Once the internal geared wheel (17) has been finished, the rotational coupling between both shaping tools (2, 4; 102, 104) is detached. The internal geared wheel (17) is detached from the slanted toothing(s) by means of a stripping member (18).

8 Claims, 2 Drawing Sheets

FLOW-TURNING DEVICE AND METHOD FOR PRODUCING INTERNALLY GEARED WHEELS USING TWO SETS OF INTERNAL TOOTHING

BACKGROUND OF THE INVENTION

The invention relates to a flow-turning device and to a method for producing internally geared wheels using two sets of internal toothing arranged axially one behind the other, at least one of which is a helical toothing. By helical toothing is also to be understood a screw thread.

Internally geared wheels having sets of internal toothing that are made of steel alloys and other metallic materials are used in particular for power transmission in driven wheels of heavy goods vehicles or tractors, for example. Internally geared wheels of this type have at their forward ends sets of internal toothing that are accessible from the outside. The two sets of internal toothing can have a different diameter if the internally geared wheel is to be used in a gearbox, for example. The internally geared wheel can have a spur toothing, in which the teeth extend parallel to the axis of rotation, or a helical toothing or screw thread.

WO 96/20050 describes a method for producing internal geared portions, in which method internally geared wheels having two sets of internal toothing are produced as a result of pressure rollers flow-turning the workpiece over shaping tools. In this connection, however, only internally geared wheels having spur toothing on both sides can be produced.

SUMMARY OF THE INVENTION

The underlying object of the invention is to improve the production of internal geared portions to the extent that even portions having two sets of internal toothing, at least one of which is a helical toothing, are simple to produce.

This object is achieved in accordance with the invention by means of the features of claims 1 and 8.

The invention proposes a flow-turning device which has a first and a second shaping tool each having an external toothing, pressure rollers for flow-turning a workpiece sitting on the shaping tools which are connected to each other, and holding means which secure the workpiece against rotation during the flow-turning of the first internal toothing on the first shaping tool. At least one of the shaping tools has a helical toothing, in which the individual teeth extend in the manner of a screw thread at an angle to the longitudinal axis of the shaping tool. There is provided at least one stripping element, which pushes the completed internally geared wheel off of the shaping tool or tools with helical toothing with relative rotation between shaping tool and internally geared wheel. During the production of the internally geared wheel, the two shaping tools are coupled to each other in a rotationally secure manner. After the production, this rotationally secure coupling is lifted, so that one shaping tool rotates together with the internally geared wheel while the internally geared wheel is detached from the other shaping tool with the aid of the stripping element. As a result of this, one-piece internally geared wheels having two sets of internal toothing, at least one of which is a helical toothing, can be produced in one operation, i.e. without having to rechuck the workpiece.

The holding means can be a movable sleeve surrounding the second shaping tool. The sleeve presses the workpiece against the first shaping tool while the first internal toothing is formed. In this connection, the sleeve holds the workpiece on the shaping tools and simultaneously secures it against rotation. After this, the sleeve is pulled back in order to be able to form the second internal toothing. The workpiece is then held firmly on the shaping tool by the first toothing.

The holding means can also be a stamped element of the first shaping tool, such as an end toothing, for example. At the start of the forming, the workpiece is pressed by the contact force of the pressure rollers on to this end toothing, so that a rotation of the workpiece is prevented without further holding means.

In a preferred embodiment of the invention, one of the shaping tools protrudes from a tool holder which is movably guided in the other shaping tool and can act upon the latter for rotational entrainment. The two shaping tools are therefore freely accessible from one side, so that the workpiece can easily be slid on to the two shaping tools and the completed internally geared wheel can easily be pushed off from the two shaping tools. Thus, it is also possible to produce internally geared wheels which have, behind a toothing, a shoulder which has a smaller diameter than the toothing, for the internally geared wheel is stripped from the shaping tools. The shaping tool does not have to be pulled out through the shoulder which has a comparatively small diameter.

In a further embodiment, the end of the second shaping tool that faces the first shaping tool has a smaller diameter than the external toothing of the second shaping tool. This renders possible a simple constructional design of the flow-turning device, for the second shaping tool is easily enclosed in an end-face bore of the first shaping tool and, after the internally geared wheel has been completed, can also easily be pulled out both from the first shaping tool and from the internally geared wheel, because the end of the shaping tool, because of its comparatively small diameter, can be moved through the internal toothing.

BRIEF DESCRIPTION OF THE DRAWINGS

Exemplifying embodiments of the invention are explained with the aid of the drawings, in which.

DETAILED DESCRIPTION OF THE INVENTION

Figure 1:
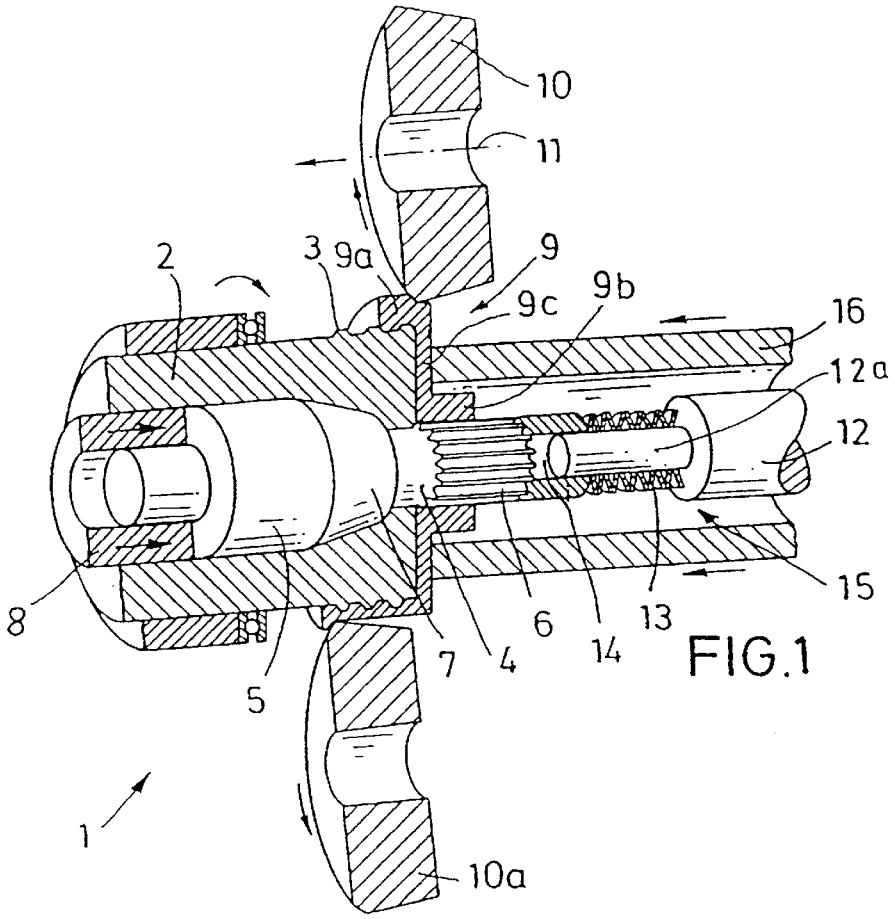
FIG. 1 shows a first exemplifying embodiment during the forming of the first toothing.
Figure 2:
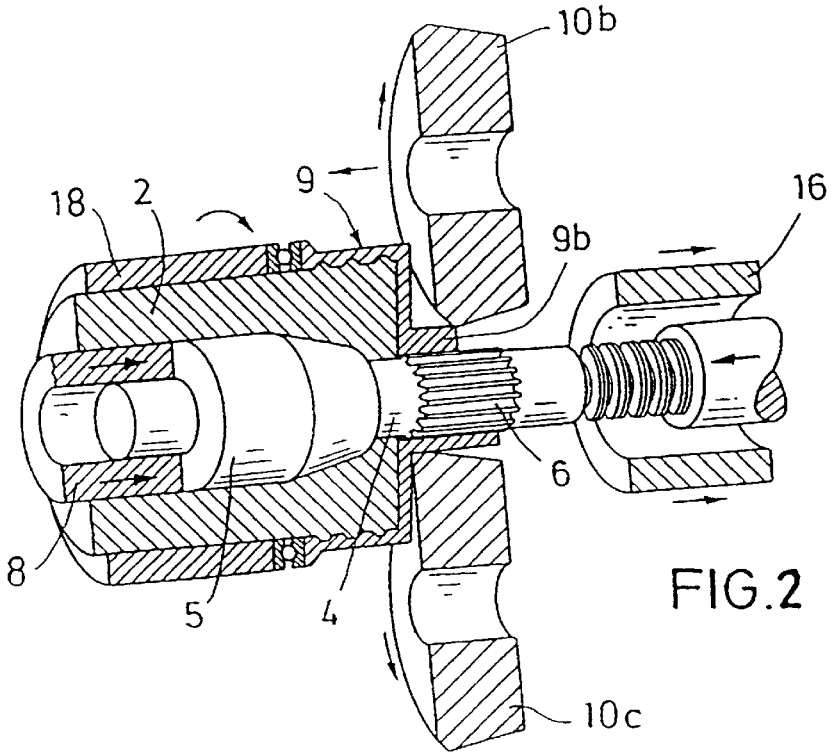
FIG. 2 shows the first exemplifying embodiment during the forming of the second toothing.
Figure 3:
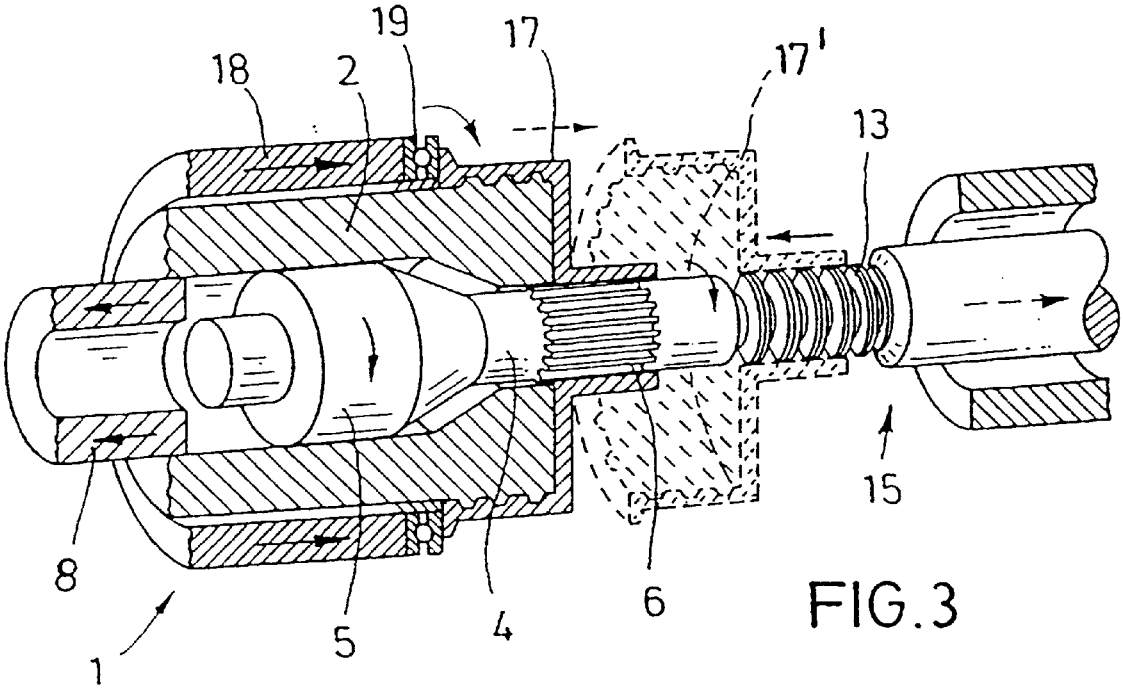
FIG. 3 shows the stripping of the internally geared wheel.

In the exemplifying embodiment of FIGS. 1 to 3, the flow-turning device 1 has a first shaping tool 2 in the form of a hollow mandrel. This is rotatably fastened on the shaft of a machine. The machine is not shown in the Figures; it is located on the left next to the flow-turning device 1. On the end facing away from the machine, the shaping tool 2 has a helical toothing 3.

A second shaping tool 4 extends in the central hollow space of the first shaping tool 2 and protrudes from an end-face opening of the first shaping tool 2. It is fastened to a shaft-side tool holder 5 which is located in the central hollow space and can be rotated and moved in the axial direction by the machine. A conical surface 7 of the movable tool holder 5 engages in a corresponding inner cone of the first shaping tool 2 for rotational entrainment. In order to generate a conical clamping between the tool holder 5 and the first shaping tool 2, a hollow mandrel 8 actuated by the machine is pressed against the first shaping tool 2. The second shaping tool 4 has on its protruding end a parallel toothing 6 which has a smaller diameter than the helical toothing 3. The two shaping tools 2, 4 consist of chromium-containing or molybdenum-containing materials which are coated and surface-hardened.

In accordance with FIG. 1, the workpiece 9 which is to be formed in order to form an internally geared wheel is already preformed in such a way that in each case there is a short tubular circumferential region 9*a* or 9*b* over the start of the sets of toothing 3 and 6 respectively. These tubular regions 9*a*, 9*b* have a greater wall thickness than the internally geared wheel to be produced, because the tubular regions 9*a*, 9*b* are flow-turned to a greater length and smaller wall thickness. The radial region 9*c* of the workpiece 9 that connects the two tubular regions 9*a*, 9*b*, on the other hand, already has the desired wall thickness because it is not subjected to deformation.

Pressure rollers 10 made of hard metal or HSS steel form the workpiece 9 on to the shaping tools 2, 4. The pressure rollers 10 are arranged in a radial plane and rotate about their centre axis 11 with simultaneous forward feed. The pressure rollers 10 are pressed with a radial force against the workpiece 9. The pressure applied in this way can amount to ≧35 t, for example. In order that the pressure rollers 10 process evenly the complete circumference of the workpiece 9, a rotatory relative movement between the workpiece 9 and the pressure rollers 10 has to take place. In order to do this, either the shaping tools 2, 4 can be rotated with the workpiece 9 held securely thereon, or the pressure rollers 10 can be moved circumferentially around the workpiece 9.

A tailstock-side mandrel 12 of the machine has a spring assembly 13 arranged around a centring pin 12*a* of the tailstock-side mandrel 12. The centring pin 12 [sic] engages in an end-face centring opening 14 of the second shaping tool 4. The mandrel 12 is movable in the axial direction. This construction forms an ejector 15, which can release the tool holder 5 from the conical clamping with the first shaping tool 2. The tailstock-side mandrel 12 and also the toothing 6 of the second shaping tool 4 are surrounded by a movable holding sleeve 16, which holds the workpiece 9 on the shaping tools 2, 4 in a rotationally secure manner.

At the start of the flow-turning operation, the workpiece 9 is pushed from the tailstock side on to the two shaping tools 2, 4, in which case the ejector 15 and the holding sleeve 16 are pulled back, i.e. separated from the second shaping tool 4. In order to secure the workpiece 9, the holding sleeve 16 is then moved forwards. It presses the workpiece 9 against the end face of the first shaping tool 2. The machine-side hollow mandrel 8 is moved forwards until the spring assembly 13 rests against the tailstock-side mandrel 12, which is moved into position, when in the compressed state. The effect of this is that the tool holder 5 enters into a conical clamping with the first shaping tool 2, something which leads to a rotationally secure coupling of the two shaping tools 2 and 4. Simultaneously, the spring assembly 13 of the ejector 15 is placed under pressure. The first shaping tool 2, the tool holder 5 with the second shaping tool 4, the hollow mandrel 8, the ejector 15 and the holding sleeve 16 therefore form together with the workpiece 9 a rotating unit.

The pressure rollers 10 are now brought up to the tubular region 9*a* of the workpiece 9 that surrounds the start of the helical toothing 3 of the first shaping tool. In this connection, each pressure roller 10 rotates about its axis 11. The pressure rollers 10 are moved jointly towards the machine, in which case they push the material of the workpiece 9 before them and simultaneously press it into the helical toothing 3 of the first shaping tool 2, so that an internal toothing is produced in the workpiece 9. A pressure roller 10*a* in the end position and also the completed first internal toothing of the workpiece 9 are shown at the bottom of FIG. 1.

FIGS. 1 and 2 each show two processing steps. In each case, the pressure roller 10 and the workpiece 9 are shown at the start of the forming in the upper half of the Figures and at the end of the forming in the lower half of each Figure.

FIG. 2 shows how the second internal toothing is formed. After the first toothing has been completed, the holding sleeve 16 is drawn back, because the workpiece 9 is now held by the first helical toothing. While the first toothing is produced in the same-direction pressing method, in which the forward-feed direction of the pressure rollers 10 corresponds to the material-flow direction, the second toothing is produced in the opposite-direction pressing method. In this connection, the material flows in the opposite direction to the forward-feed direction of the pressure rollers 10. Starting from a starting position 10*b* of the pressure rollers 10, the latter are moved towards the first shaping tool 2. In this connection, the material which becomes soft in places under the pressure roller 10 is pressed into the contours of the parallel toothing 6 and thereby pressed in the direction of the tailstock, so that the internal thread of the workpiece 9 is formed completely once the pressure rollers 10 have reached the end position 10*c*.

The manner in which the completed internally geared wheel 17 is removed from the flow-turning device 1 is now explained with the aid of FIG. 3. After the pressure rollers 10 have been moved away from the internally geared wheel 17, the machine-side hollow mandrel 8 is moved back, so that the spring assembly 13 pushes the tool carrier 5 with the second shaping tool 4, which has the parallel toothing 6, out of the conical clamping in the first shaping tool 2. Because of the parallel toothing 6 of the second shaping tool 4, the latter can be moved in the internally geared wheel 17. If the second toothing 6 is a helical toothing, the detachable rotational coupling between the first shaping tool 2 and the second shaping tool 4 is realised in another way, because the second shaping tool 4 would no longer be able to be shifted in the axial direction in the internally geared wheel 17. The rotational coupling can, for example, be realised with detent pawls which engage in the other shaping tool and are pulled back again after the internally geared wheel 17 has been completed.

After the rotational coupling between the two shaping tools 2, 4 has been removed, a stripping sleeve 18, which surrounds the first shaping tool 2, is pressed against the end face of the internally geared wheel 17. The stripping sleeve 18 has, on its end face which presses against the internally geared wheel 17, an axial bearing 19, so that translational, but not rotational, movements can be transmitted. In order to release the internally geared wheel 17, the stripping sleeve 18 is pressed against the end face of the internally geared wheel 17, so that the latter is pushed in a rotating manner away from the first shaping tool 2. At the same time, the internally geared wheel 17 slides in the direction of the tailstock and is thus pushed in a rotating manner away from the shaping tool 42 [sic]. The released internally geared wheel 17' (here shown with dashed lines) can be removed from the flow-turning device 1 as soon as the ejector 15 is moved to the tailstock side and thus separated from the second shaping tool 4.

If the second toothing 6 is also a helical toothing, there is provided a second stripping sleeve which extends on the ejector 15, in order to be able to detach the internally geared wheel 17 from the second toothing as well in the same way.

Figure 4:
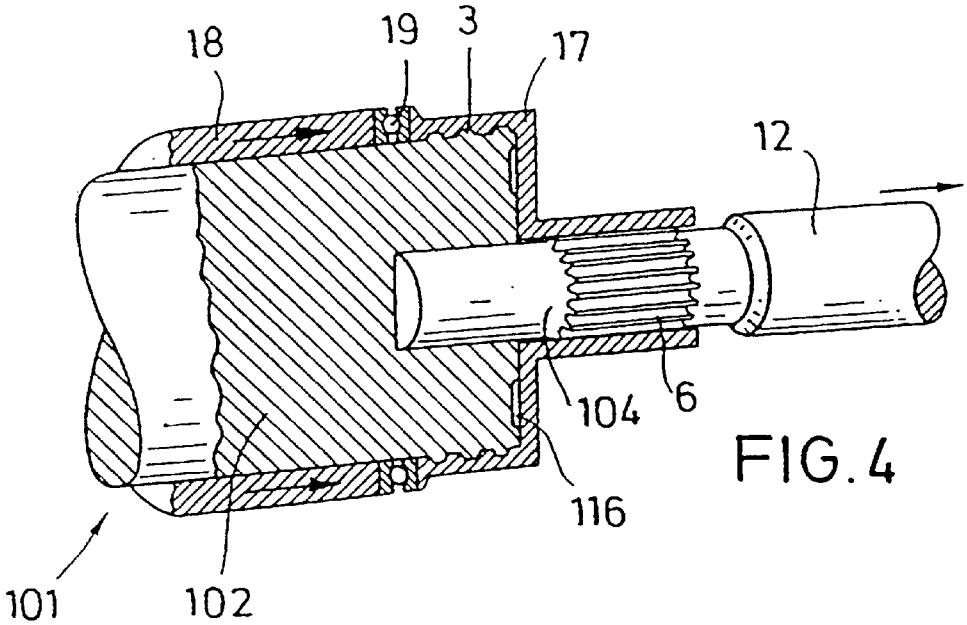
FIG. 4 shows a second exemplifying embodiment.

FIG. 4 shows a second exemplifying embodiment of the flow-turning device 101. The first shaping tool 102 likewise has a helical toothing 3. It is, however, not constructed as a hollow mandrel, but instead is tubular with an end-face central opening in which the second shaping tool 104 engages. The second shaping tool 104 has a parallel toothing 6 and is securely connected to the tailstock-side tool mandrel 12.

In order to place the workpiece in the flow-turning device 101, first of all the tailstock-side tool mandrel with the second shaping tool 104 is pulled out of the first shaping tool 102 and the workpiece is positioned on the first shaping tool 102 and then the second shaping tool 104 is pushed through the workpiece into the opening of the first shaping tool 102. A rotationally secure coupling of the two shaping tools 102, 104 can take place by pressing together the two shaping tools 102, 104 or, for example, by detent pawls (not shown). Then, as described above, the first internal toothing is formed. A holding sleeve is not absolutely necessary, because the first shaping tool 102 has an end-face toothing 116, against which the workpiece is pressed by the pressure rollers at the start of the shaping process, so that the workpiece and the first shaping tool 102 enter into a rotationally secure connection. Additionally, however, a holding sleeve can still be provided. The second internal toothing is also formed as described above. After the internally geared wheel 17 has been completed, the rotational coupling between the two shaping tools 102, 104 is released, the stripping sleeve 18 is pressed against the internally geared wheel 17 and the first shaping tool 102 is rotated out of the internal toothing of the internally geared wheel 17. The tailstock-side tool mandrel 12 is pulled out of the internally geared wheel 17, so that the latter can be removed from the flow-turning device 101.

What is claimed is:

1. Flow-turning device (1; 101) for producing an internally geared wheel (17) having two sets of internal toothing, said flow-turning device having a first (2; 102) and a second (4; 104) shaping tool each having an external toothing (3, 6), in which device the two shaping tools (2, 4; 102, 104) can be coupled to each other in a rotationally secure manner for flow-turning, the flow-turning device having pressure rollers (10) for flow-turning a workpiece (9) sitting on the shaping tools (2, 4; 102, 104) which are connected to each other, and having holding means (16; 116) which secure the workpiece (9) against rotation during the flow-turning of the first internal toothing on the first shaping tool (2; 102), characterised in that at least one shaping tool (2; 102) has a helical toothing (3), and in that there is provided at least one stripping element (18) which is movable in the longitudinal direction and which, after the mutual coupling of the two shaping tools (2, 4; 102, 104) has been released, pushes the completed internally geared wheel (17) off of one shaping tool (2; 102) with helical toothing (3) with relative rotation between shaping tool (2; 102) and internally geared wheel (17).

2. Flow-turning device according to claim 1, characterised in that the holding means is a sleeve (16) surrounding the second shaping tool (4; 104).

3. Flow-turning device according to claim 1, characterised in that the holding means is a stamped element (116) of the first shaping tool (102).

4. Flow-turning device according to claim 1, characterised in that the stripping element (18) is a sleeve which is movable on a shaping tool (2; 102) and can be pressed with an axial bearing (19) against the internally geared wheel (17).

5. Flow-turning device according to claim 1, characterised in that the one shaping tool (4) protrudes from a tool holder (5) which is movably guided in the other shaping tool (2) and acts on the latter for rotational entrainment.

6. Flow-turning device according to claim 5, characterised in that an ejector (15) for releasing the rotational entrainment after the end of production acts on the free end of the one shaping tool (4).

7. Flow-turning device according to claim 5, characterised in that the end of the second shaping tool (104) that is coupled with the first shaping tool (102) has a smaller diameter than the outside toothing (6) of the second shaping tool (104), so that the second shaping tool (104) can be pulled out of the internally geared wheel (17).

8. Method for producing internally geared wheels (17) having two sets of internal toothing, at least one of which is a helical toothing, using a device (1; 101) which has a first (2; 102) and a second (4; 104) shaping tool each having an external toothing (3, 6) and pressure rollers (10) for flow-turning a workpiece (9) on the sets of external toothing (3, 6) of the shaping tools (2; 102, 4; 104), the method having the following steps:

placing the workpiece (9) on the shaping tools (2; 102, 4; 104), securely coupling of the two shaping tools (2; 102, 4; 104) against rotation, activating at least one holding means (16; 116) for rotationally securing the workpiece (9) during the flow-turning of the first internal toothing on the first shaping tool (2; 102), flow-turning on the first shaping tool (2; 102), flow-turning on the second shaping tool (4; 104)

releasing the rotational securing between the two shaping tools (2, 4; 102, 104), pushing the internally geared wheel (17) from one shaping tool (2; 102) with a stripping element (18), and separating the internally geared wheel (17) from the other shaping tool (4; 104).

* * * * *